US006679690B2

(12) United States Patent
Fushiki et al.

(10) Patent No.: US 6,679,690 B2
(45) Date of Patent: Jan. 20, 2004

(54) SCROLL COMPRESSOR INCLUDING GUIDE FRAME AND COMPLIANT FRAME

(75) Inventors: Takeshi Fushiki, Tokyo (JP); Kiyoharu Ikeda, Tokyo (JP); Teruhiko Nishiki, Tokyo (JP); Yoshihide Ogawa, Tokyo (JP); Takashi Sebata, Tokyo (JP); Fumiaki Sano, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/220,638

(22) PCT Filed: Jan. 31, 2001

(86) PCT No.: PCT/JP01/00640

§ 371 (c)(1),
(2), (4) Date: Sep. 4, 2002

(87) PCT Pub. No.: WO02/061284

PCT Pub. Date: Aug. 8, 2002

(65) Prior Publication Data

US 2003/0031576 A1 Feb. 13, 2003

(51) Int. Cl.[7] ..... F04C 18/04

(52) U.S. Cl. ..... 418/55.5; 418/55.4; 418/149

(58) Field of Search ..... 418/55.1, 55.4, 418/55.5, 57, 149; 29/888.022

(56) References Cited

U.S. PATENT DOCUMENTS

| | | | | | |
|---|---|---|---|---|---|
| 5,630,712 | A | * | 5/1997 | Sakai et al. | 418/55.4 |
| 6,077,057 | A | * | 6/2000 | Hugenroth et al. | 418/55.4 |
| 6,135,739 | A | * | 10/2000 | Ogawa et al. | 418/55.5 |
| 6,241,495 | B1 | * | 6/2001 | Chang | 418/55.1 |

FOREIGN PATENT DOCUMENTS

| | | |
|---|---|---|
| JP | 11-107938 | 4/1999 |
| JP | 2000-337276 | 12/2000 |

* cited by examiner

*Primary Examiner*—John J. Vrablik
(74) *Attorney, Agent, or Firm*—Oblon, Spivak, McClelland, Maier & Neustadt, P.C.

(57) ABSTRACT

A scroll compressor including a guide frame (22) for fixing a fixed scroll member (12) and a compliant frame (24) for supporting an oscillating scroll member (14) in the axial direction of the scroll compressor in the guide frame (22), wherein the guide frame (22) has a plurality of cylindrical surfaces (33, 35), and the compliant frame (24) has a plurality of cylindrical surfaces (23, 25) which engage with the cylindrical surfaces (33, 35), and wherein in order to facilitate assembling of the guide frame (22) and the compliant frame (24), the first cylindrical surfaces (25, 35) are first engaged with each other when the compliant frame (24) is inserted into the guide frame (22), that is, the cylindrical surfaces are engaged in the order of increase in diameter.

3 Claims, 6 Drawing Sheets

PRIOR ART

PRIOR ART

PRIOR ART

SCROLL COMPRESSOR INCLUDING GUIDE FRAME AND COMPLIANT FRAME

FIELD OF THE INVENTION

The present invention relates generally to a scroll compressor for use in a refrigerator, an air conditioner, or the like.

BACKGROUND OF THE INVENTION

One of conventional scroll compressors known in the art is, for example, disclosed in JP-A-2000-161254 and its construction will be described with reference to FIG. 6.

A fixed scroll member 12 and an oscillating scroll member 14 are disposed in a closed vessel 10. The fixed scroll member 12 and the oscillating scroll member 14 have plate-like scroll teeth 16 and 18 having substantially the same shape, respectively. The plate-like scroll teeth 16 and 18 are in gear with each other so as to form a compression chamber 20 which changes in volume relatively between the plate-like scroll teeth 16 and 18.

The fixed scroll member 12 is fixed to a guide frame 22 by a plurality of bolts which are not shown. The guide frame 22 is fixedly attached to the inner wall of the closed vessel 10 by such means as shrink-fitting or welding. The oscillating scroll member 14 and a compliant frame 24 are received in an internal space formed by the fixed scroll member 12 and the guide frame 22. The compliant frame 24 is located under the oscillating scroll member 14 so as to support the oscillating scroll member 14 in the axial direction of the scroll compressor.

At substantially the center portion of a base plate portion 15 of the oscillating scroll member 14, a hollow cylindrical boss portion 26 is formed to extend into the inside of the compliant frame 24. A crank shaft 29 in the upper end portion of a main shaft 28 is rotatably connected to the boss portion 26 through a bearing 27.

The main shaft 28 is driven to rotate by a motor 30. The motor 30 is constituted by a rotor 31 fixed to the main shaft 28, and a stator 32 fixed to the inner wall of the closed vessel 10. The main shaft 28 extends downward so as to be rotatably supported by the compliant frame 24 through first and second bearings 34 and 36 disposed at the upper portion, and by a sub-frame 35 through a third bearing 38 disposed at the lower portion. Further, a main shaft balancer 41 is fixedly attached to the main shaft 28 at the lower side of the crank shaft 29 by shrink-fitting, etc, and an upper balancer 42 and a lower balancer 43 are fixed to the main shaft 28 on the upper and lower surfaces of the rotor 31 respectively. Static balance and dynamic balance of the main shaft 28 are ensured by the three balancers 41, 42 and 43. Incidentally, in FIG. 6, the reference numeral 44 represents glass-sealed terminals for motor power supply purposes.

In addition, an Oldham's ring 45 is mounted on the compliant frame 24 so as to prevent the oscillating scroll member 14 from rotating on its own axis. The Oldham's ring 45 has two pairs of claws 46 and 47, and the claws 46 and 47 in each pair have a phase difference of 90 degrees from each other (in FIG. 1, the claws 46 and 47 are shown to have a phase difference of 180 degrees in order to facilitate understanding). The claws 46 are engaged with two Oldham's guide grooves 48 so that the claws 46 can slide in the grooves 48 reciprocatingly, respectively. The Oldham's guide grooves 48 are formed substantially in a straight line on a base plate portion 13 of the fixed scroll member 12. The claws 47 are engaged with two Oldham's guide grooves 49 so that the claws 47 can slide in the grooves 49 reciprocatingly, respectively. The Oldham's guide grooves 49 are formed substantially in a straight line on the base plate portion 15 of the oscillating scroll member 14 and the Oldham's guide grooves 49 have a phase difference of 90 degrees with respect to the Oldham's guide grooves 48, respectively. Thus, the oscillating scroll member 14 driven by the rotation of the crank shaft 29 of the main shaft 28 makes an eccentric turning motion without rotating on its own axis.

The compliant frame 24 has at least two cylindrical surfaces 23 and 25 in its upper and lower outer circumferential portions, respectively. The cylindrical surfaces 23 and 25 engage with cylindrical surfaces 33 and 35 formed in the guide frame 22 so as to be supported in the radial direction of the scroll compressor, respectively. The compliant frame 24 and the guide frame 22 are fitted over each other through upper and lower sealing materials 37 and 39. Thus, a frame space 50 formed between the two members 24 and 22 is sealed off by the sealing materials 37 and 39.

The frame space 50 communicates with a communication passageway 51 provided in the compliant frame 24. The upper end portion of the communication passageway 51 is somewhat expanded in diameter so as to form an opening portion 52. The opening portion 52 is opened to the upper end surface of the compliant frame 24. The upper end surface of the compliant frame 24 serves as a thrust bearing 56. The oscillating scroll member 14 is supported through the thrust bearing 56 slidably in pressure contact with a thrust surface 58. The thrust surface 58 is formed on the lower surface of the base plate portion 15 of the oscillating scroll member 14.

An extraction hole 53 is provided in the base plate portion 15 of the oscillating scroll member 14. A lower end opening portion 54 of the extraction hole 53 is opened to the thrust surface 58 while its upper end opening portion 55 is opened to the compression chamber 20. Further, the thrust-surface-side opening portion 54 of the extraction hole 53 is located so that the circular locus of the opening portion stays in the opening portion 52 of the communication passageway 51 opened to the thrust bearing 56 surface of the compliant frame 24 during the normal operation. Thus, there is no leak to a suction pressure atmosphere space 17 because of the oscillating scroll member 14 and the compliant frame 24 sliding in close contact with each other.

The suction pressure atmosphere space 17 is provided in the outer circumferential portion of the base plate portion 13 of the fixed scroll member 12. A suction pipe 19 for refrigerant gas is press fit into the space 17 through the closed vessel 10. In addition, a discharge port 21 for compressed refrigerant gas is provided in the base plate portion 13. The discharge port 21 communicates with a high pressure chamber 40 formed between the fixed scroll member 12 and the closed vessel 10. The discharge port 21 further communicates with a similar high pressure chamber 62 under the guide frame 22 through a passageway 60. The passageway 60 is composed of a notch groove provided in the outer circumferential portions of the fixed scroll member 12 and the guide frame 22. A discharge pipe 64 is attached to the closed vessel 10 so as to communicate with the high pressure chamber 62.

Lubricating oil 70 such as refrigerating machine oil is stored in the bottom portion of the closed vessel 10. An oil pipe 72 connected with the lower end portion of the main shaft 28 is inserted into the lubricating oil 70. The lubricating oil 70 sucked up through the oil pipe 72 passes through an oil passageway hole 74 extending through the main shaft 28 in its axial direction. Thus, the lubricating oil 70 is directed to the bearing portion 27 of the crank shaft 29 through an opening portion 76 at the upper end of the oil passageway hole. Further, the lubricating oil 70 lubricating the bearing portion 27 fills a space (boss portion space) 78 surrounded by the oscillating scroll member 14 and the compliant frame 24.

FIG. 7 is a partially sectional view showing a pressure regulating mechanism provided in the compliant frame 24.

As shown in FIG. 7, an intermediate pressure regulating valve 80 is incorporated in the compliant frame 24. The intermediate pressure regulating valve 80 uses a spring 81 to close a regulating valve front channel 82. The regulating valve front channel 82 communicates with the boss portion space 78. On the other hand, a regulating valve rear channel 83 communicates with a valve chamber and a base plate outer circumferential portion space, that is, the suction pressure atmosphere space 17 which is low in pressure.

Next, description will be made about the basic operation of this conventional scroll compressor. The low-pressure sucked refrigerant enters the compression chamber 20 from the suction pipe 19. The compression chamber 20 is formed by the plate-like scroll teeth 16 of the fixed scroll member 12 and the plate-like scroll teeth 18 of the oscillating scroll member 14. The plate-like scroll teeth 16 and 18 are in gear with each other. The oscillating scroll member 14 driven by the motor 30 makes an eccentric turning motion while reducing the volume of the compression chamber 20 toward the center portion. By this compression stroke, the sucked refrigerant becomes high in pressure. Thus, the sucked refrigerant is discharged into the closed vessel 10 through the discharge port 21 of the fixed scroll member 12. In addition, on the abovementioned compression stroke, the refrigerant gas of intermediate pressure on the way of compression is directed from the extraction hole 53 of the oscillating scroll member 14 to the frame space 50 through the passageway 60 of the compliant frame 24. Thus, the intermediate pressure atmosphere of the space 50 is maintained. The discharge gas increased in pressure fills the closed vessel 10 with the high pressure atmosphere. The discharge gas is eventually discharged from the discharge pipe 64 to the outside of the compressor.

The lubricating oil 70 in the bottom portion of the closed vessel 10 is directed to the bearing portion 27 of the crank shaft 29 through the oil passageway hole 74 of the main shaft 28 by the high pressure in the closed vessel 10. The lubricating oil attains an intermediate pressure by the throttling action of the bearing portion 27, and it fills the boss portion space 78 surrounded by the oscillating scroll member 14 and the compliant frame 24. Then, the lubricating oil 70 is introduced into the low pressure atmosphere space 17 via the intermediate pressure regulating valve 80 which connects the space 78 and the low pressure atmosphere space 17. Thus, the lubricating oil 70 is sucked into the compression chamber 20 together with the low pressure refrigerant gas. On the compression stroke, the lubricating oil 70 is released into the closed vessel 10 through the discharge port 21 together with the high pressure refrigerant gas. In the closed vessel 10, the lubricating oil 70 is separated from the refrigerant gas, and returned into the bottom portion of the closed vessel again. In addition, the boss portion space 78 is set to maintain a differential pressure defined by the product of the spring constant of the intermediate pressure regulating spring 81 and the sectional area of the regulating valve front channel 82, and to have an intermediate pressure higher than the low pressure atmosphere space 17 by the differential pressure. Thus, the downward force acting on the oscillating scroll member 14 is partially canceled by this intermediate pressure so that the thrust force can be reduced.

The sum of the thrust gas force with which the fixed scroll member 12 and the oscillating scroll member 14 tend to be separated from each other by the compression operation in the axial direction and the force with which the compliant frame 24 and the oscillating scroll member 14 tend to be separated from each other by the intermediate pressure of the boss portion space 78 acts against the compliant frame 24 as a downward force in the drawing.

On the other hand, the sum of the differential pressure between the force tending to separate the compliant frame 24 from the guide frame 22 by the pressure of the frame space 50 to which the refrigerant gas on the way of compression has been directed to form an intermediate pressure atmosphere and the pressure acting on the lower portion of the guide frame 22 which is exposed to the high pressure atmosphere acts as an upward force.

During the steady-state operation, the above-mentioned upward force is set to exceed the downward force. Thus, the engaged upper and lower cylindrical surfaces 23 and 25 of the compliant frame 24 are guided by the cylindrical surfaces 33 and 35 of the guide frame 22. Thus, the compliant frame 24 floats upward. The oscillating scroll member 14 slides on the compliant frame 24 in close contact therewith. Thus, the oscillating scroll member 14 floats in the same manner as the compliant frame 24, and it slides on the fixed scroll member 12 while bringing the plate-like scroll teeth 18 of the oscillating scroll member 14 into contact with the fixed scroll member 12.

On the other hand, the above-mentioned thrust gas force increases during the starting, fluid compression or the like of the scroll compressor. Thus, the oscillating scroll member 14 strongly presses down the compliant frame 24 through the thrust bearing 56. As a result, there is produced a comparatively large clearance between the tooth top and the tooth bottom of the plate-like scroll teeth 18 and 16 of the oscillating scroll member 14 and the fixed scroll member 12. Thus, any abnormal pressure rise in the compression chamber 20 is avoided. This action is called a relief action, and the amount of the produced clearance is called a relief amount.

The relief amount is controlled by a distance of travel until the compliant frame 24 and the guide frame 22 collide with each other.

A part or all of upsetting moment generated in the oscillating scroll member 14 is transmitted to the compliant frame 24 through the thrust bearing 56. On the other hand, a bearing load applied by the first bearing 34 of the main shaft 28, and a resultant of two reactions of the bearing load, that is, a couple produced by a resultant of counterforces produced by the upper and lower cylindrical engaging surfaces (23, 33; 25, 35) of the compliant frame 24 and of the guide frame 22 act on the compliant frame 24 so as to cancel the above-mentioned upsetting moment. Thus, excellent follow-up action stability and relief action stability are ensured during the steady-state operation.

With the conventional scroll compressor, however, there has been a problem at the time of assembling the compliant frame and the guide frame, as follows. In other words, the compliant frame has to be inserted into the guide frame straightly. If the compliant frame is inserted even with a slight inclination, jamming is caused for the compliant frame. Once the compliant frame is brought into such a jamming condition, it is very difficult to further insert the compliant frame or reinsert it from the first. In addition, if the compliant frame is forcibly inserted by hammering with a wooden hammer or the like, the cylindrical engaging surfaces are often damaged or the sealing materials are often damaged or broken. Further, the compliant frame is rotated and adjusted in phase after it has been inserted into the guide frame in the prior art. This operation also causes damage or the like to the sealing materials. In addition, there may arise a mistake such as forgetting to set the sealing materials in place.

DISCLOSURE OF THE INVENTION

The present invention has been made to solve the foregoing problems, and it is an object of the present invention to provide a scroll compressor in which a compliant frame and a guide frame are assembled easily. Particularly, the present invention provides a scroll compressor in which normal assembling of a compliant frame and a guide frame can be made easily.

It is another object of the present invention to provide a scroll compressor in which the compliant frame is adjusted in phase as soon as the compliant frame is inserted.

According to an aspect of the present invention, there is provided a scroll compressor provided in a closed vessel and including: a fixed scroll member attached to a guide frame fixed to the closed vessel; an oscillating scroll member having plate-like scroll teeth engaging with plate-like scroll teeth of the fixed scroll member so as to form a compression chamber between the plate-like scroll teeth of the oscillating scroll member and the plate-like scroll teeth of the fixed scroll member; a compliant frame for supporting the oscillating scroll frame in an axial direction of the scroll compressor in the guide frame; and at least two pairs of cylindrical surfaces, each pair of the cylindrical surfaces being provided in the compliant frame and the guide frame, respectively, one pair of the two pairs being different in diameter from the other pair, thereby supporting the compliant frame in a radial direction of the scroll compressor, and whereby when the compliant frame is inserted into the guide frame, the cylindrical surfaces in pairs are engaged successively in order of increase in diameter.

Thus, the scroll compressor according to the present invention has a feature that the order of places where the compliant frame and guide frame are engaged with each other is defined when the compliant frame is to be inserted into the guide frame. In other words, the first cylindrical surfaces small in diameter are first engaged with each other and the other cylindrical surfaces large in diameter are then engaged with each other in order of increase in diameter. As a result, by the leading action of the first cylindrical surfaces, the insertion of the compliant frame becomes easy, and the compliant frame tends to become difficult to be inclined. Accordingly, it is possible to insert the compliant frame straightly and smoothly without producing any jamming. Thus, it becomes easy to assemble the compliant frame and the guide frame.

According to another aspect of the invention, in the scroll compressor at least two sealing materials are provided for sealing off a frame space formed between the compliant frame and the guide frame so that when the compliant frame is to be inserted into the guide frame, the cylindrical surfaces are engaged first with each other in each pair and then the sealing materials are engaged.

After the two pairs of the cylindrical surfaces have been engaged with each other respectively, the sealing materials are engaged. Accordingly, the sealing materials are engaged while being guided straightly. Thus, it is possible to prevent the sealing materials from being damaged or the like.

According to a further aspect of the invention, in the scroll compressor phase setting means for the compliant frame is provided so that when the compliant frame is to be inserted into the guide frame, the sealing materials are engaged after the compliant frame has been locked in phase with respect to the guide frame by the phase setting means.

By this phase setting means, the phase of the compliant frame, that is, the position of a communication passageway provided in the compliant frame is determined as soon as the compliant frame is inserted. Accordingly, it is not necessary to rotate the compliant frame to position the communication passageway after the compliant frame is inserted. Thus, it is possible to prevent the sealing materials from being damaged or the like.

According to a further aspect of the invention, in the scroll compressor the phase setting means is constituted by at least one pin and one hole, or similar means, so as to prevent the compliant frame from rotating while allowing the compliant frame to move in the axial direction.

A combination of a pin and a hole, a combination of a key and a key groove, or any other means, may be employed as the phase setting means so long as they prevent the compliant frame from rotating but allow the compliant frame to move in the axial direction (vertical movements).

According to a further aspect of the invention, in the scroll compressor all of the sealing materials are mounted on the compliant frame.

Since the presence of the sealing materials can be confirmed easily by visual observation, it is possible to prevent a mistake such as forgetting to set the sealing materials in place.

According to a further aspect of the invention, in the scroll compressor clearances between the compliant frame and the guide frame at the places of engagement of the cylindrical surfaces are smaller than clearances between the compliant frame and the guide frame at the places of engagement of the sealing materials.

According to a further aspect of the invention, in the scroll compressor one of the sealing materials is attached to an insert-direction rear portion of the small-diameter first cylindrical surface, and a seal portion cylindrical surface on which the sealing material is mounted is formed to be slightly smaller than the first cylindrical surface.

According to a further aspect of the invention, in the scroll compressor stated in claim 6, preferably, as defined in claim 7, one of the sealing materials is attached to an insert-direction rear portion of the small-diameter first cylindrical surface, and a seal portion cylindrical surface on which the sealing material is mounted is formed to be slightly smaller than the first cylindrical surface.

The first cylindrical surfaces are first engaged with each other between the compliant frame and the guide frame to play the role of leading when the compliant frame is to be inserted into the guide frame. Accordingly, the fitting tolerance for the guide portion cylindrical surface and the seal portion cylindrical surface in the first cylindrical surface is particularly important to obtain the above-mentioned effect effectively. By forming the seal portion cylindrical surface to be slightly smaller than the guide portion cylindrical surface, the leading function and the normal sealing action of the first sealing material are positively ensured.

THE BEST MODE FOR CARRYING OUT THE INVENTION

Some embodiments of the present invention will now be described with reference to the drawings. However, the present invention is not limited to such illustrated embodiments.

Embodiment 1

Figure 1:
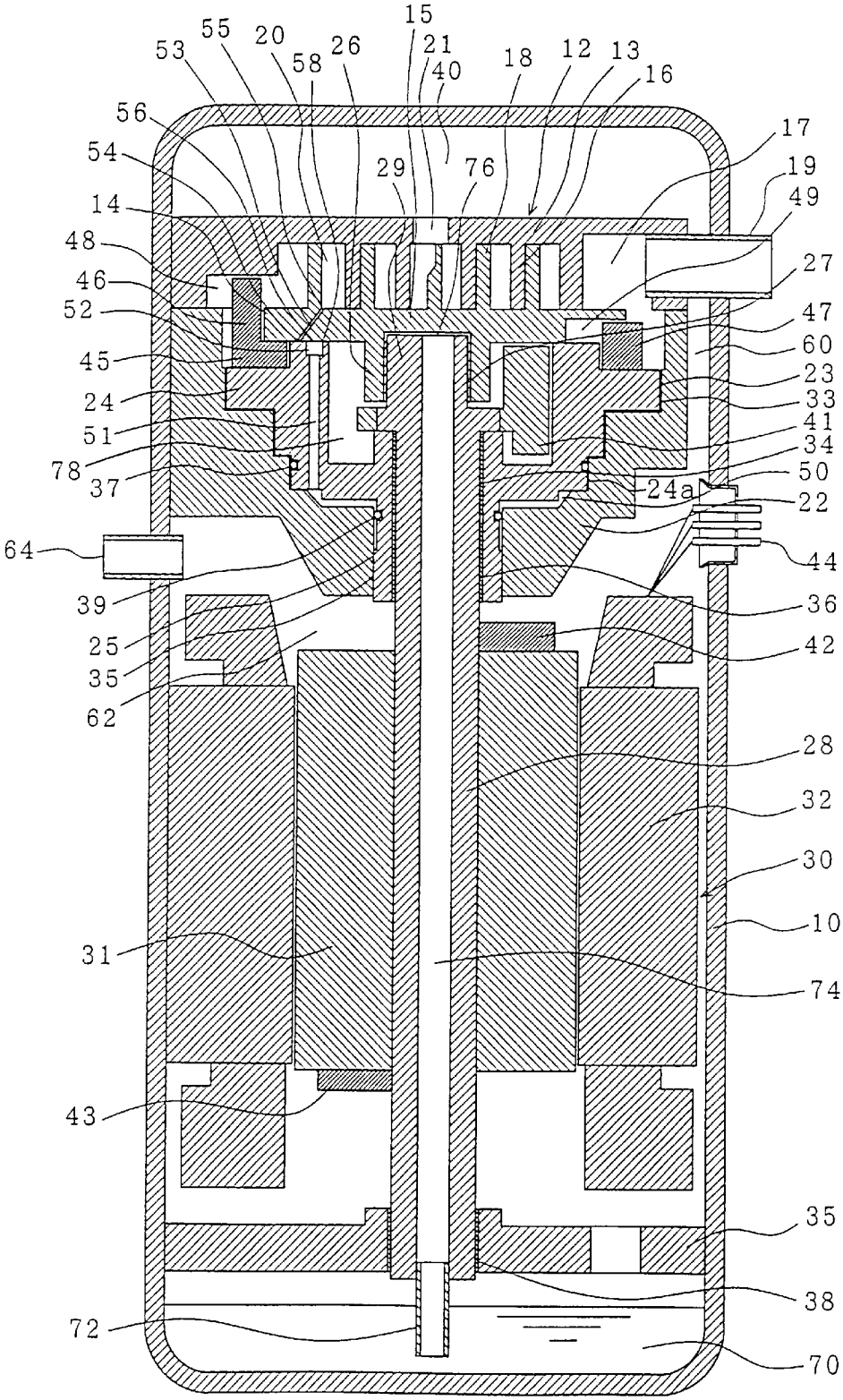
FIG. 1 is a longitudinally sectional view of a scroll compressor according to Embodiment 1 of the present invention.
Figure 6:
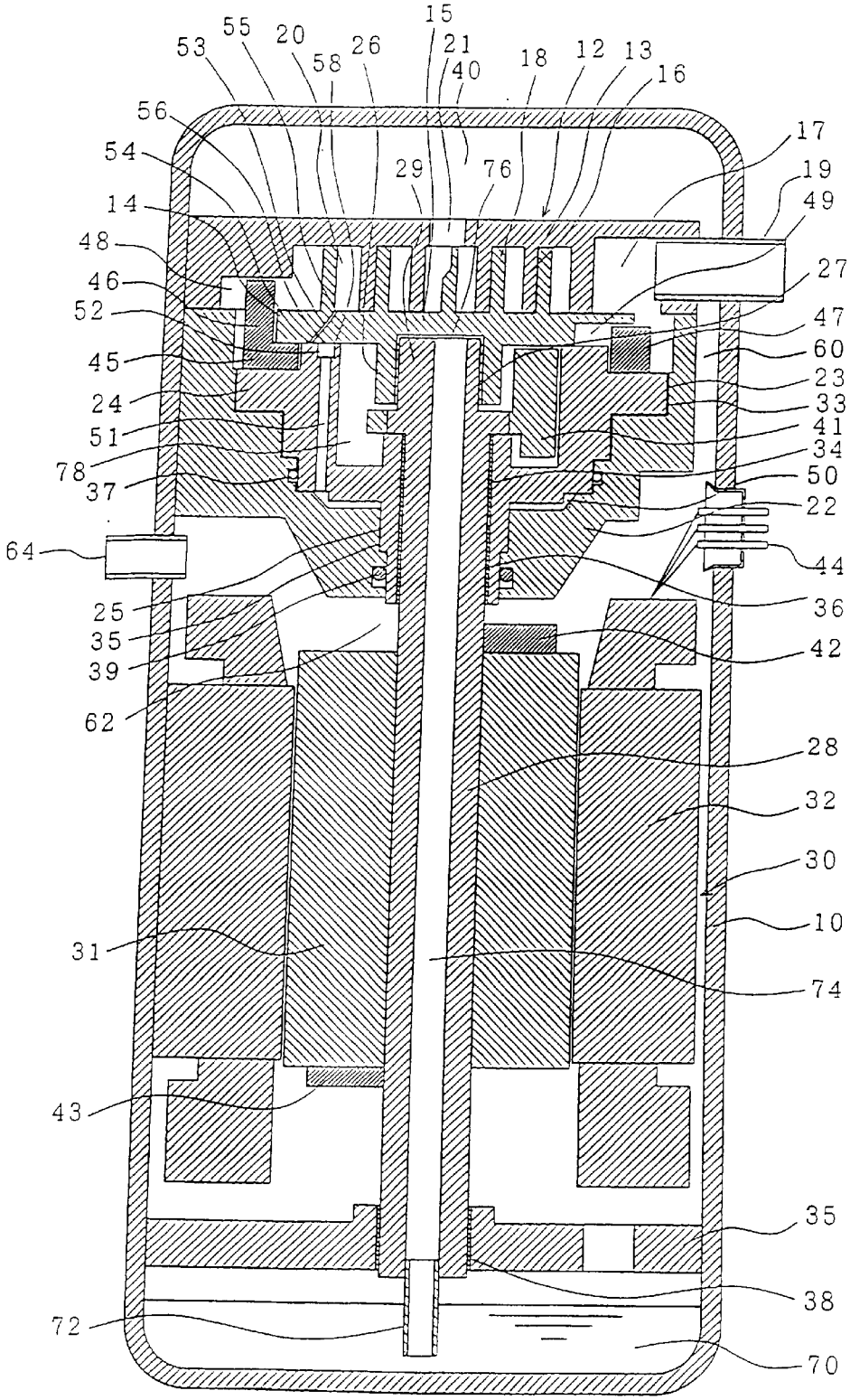
FIG. 6 is a longitudinally sectional view of a conventional scroll compressor.
Figure 7:
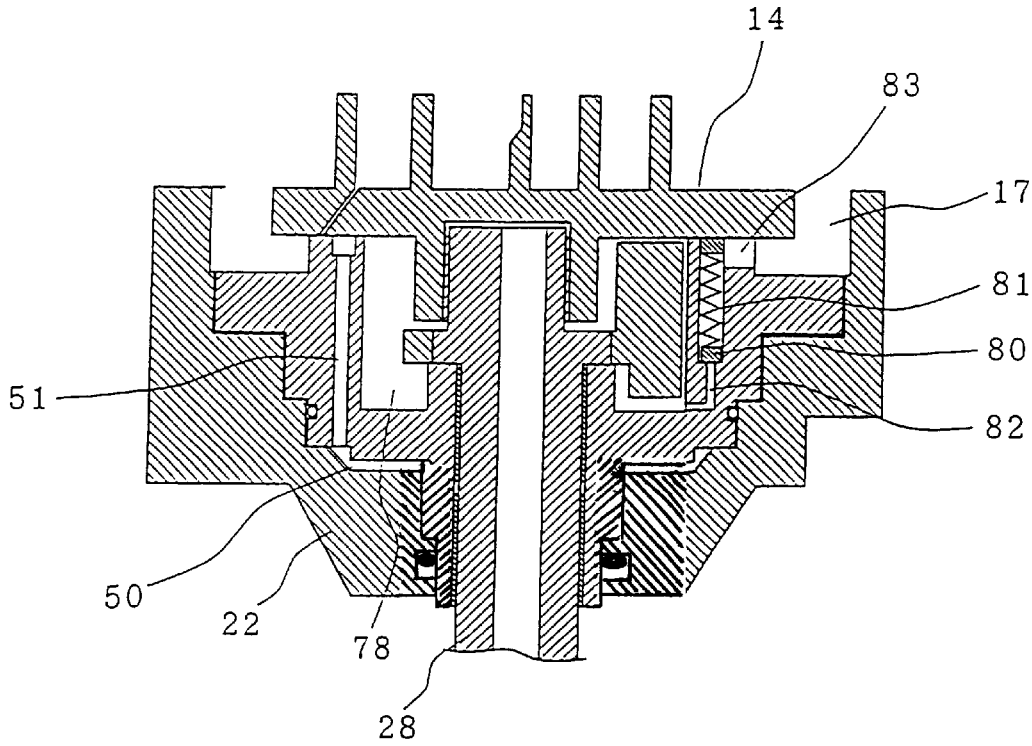
FIG. 7 is a longitudinally sectional view showing the pressure regulating mechanism of the conventional scroll compressor.

FIG. 1 shows the overall construction of an assembled scroll compressor according to the present invention. Basically, the component parts used in the present invention are the same as their counterparts in the conventional compressor shown in FIG. 6, and are therefore the same in functions. Therefore, the same reference numerals as those in FIG. 6 are used, and description will be made chiefly about the items relating to the present invention.

As shown in FIG. 1, a compliant frame 24 has an upper or second cylindrical surface 23 and a lower or first cylindrical surface 25 which is smaller in diameter than the cylindrical surface 23. The lower or first cylindrical surface 25 is shaped to have a substantially straight (substantially the uniform outer diameter) outer circumferential surface. The total length of the lower cylindrical surface (first cylindrical surface) 25 is substantially the same as the total length of the lower cylindrical surface 25 including the stepped portion in the conventional compressor. In addition, the length of the lower cylindrical surface (first cylindrical surface) 25 is larger than that of the upper cylindrical surface (second cylindrical surface) 23. According to the present invention, a lower sealing material (first sealing material) 39 is attached to the outer circumferential portion of the lower cylindrical surface 25, particularly the rear portion of the compliant frame 24 in the direction of insertion. Similarly, an upper sealing material (second sealing material) 37 is also attached to the compliant frame 24 side. Specifically, the upper sealing material 37 is attached to an intermediate cylindrical surface 24*a* formed into a stepped shape between the upper cylindrical surface 23 and the lower cylindrical surface 25. Accordingly, when the compliant frame 24 is inserted, the presence of the sealing materials 37 and 39 can be confirmed easily by virtual observation. Thus, it is possible to prevent a failure or a mistake such as forgetting to set the sealing materials 37 and 39 in place.

Figure 2:
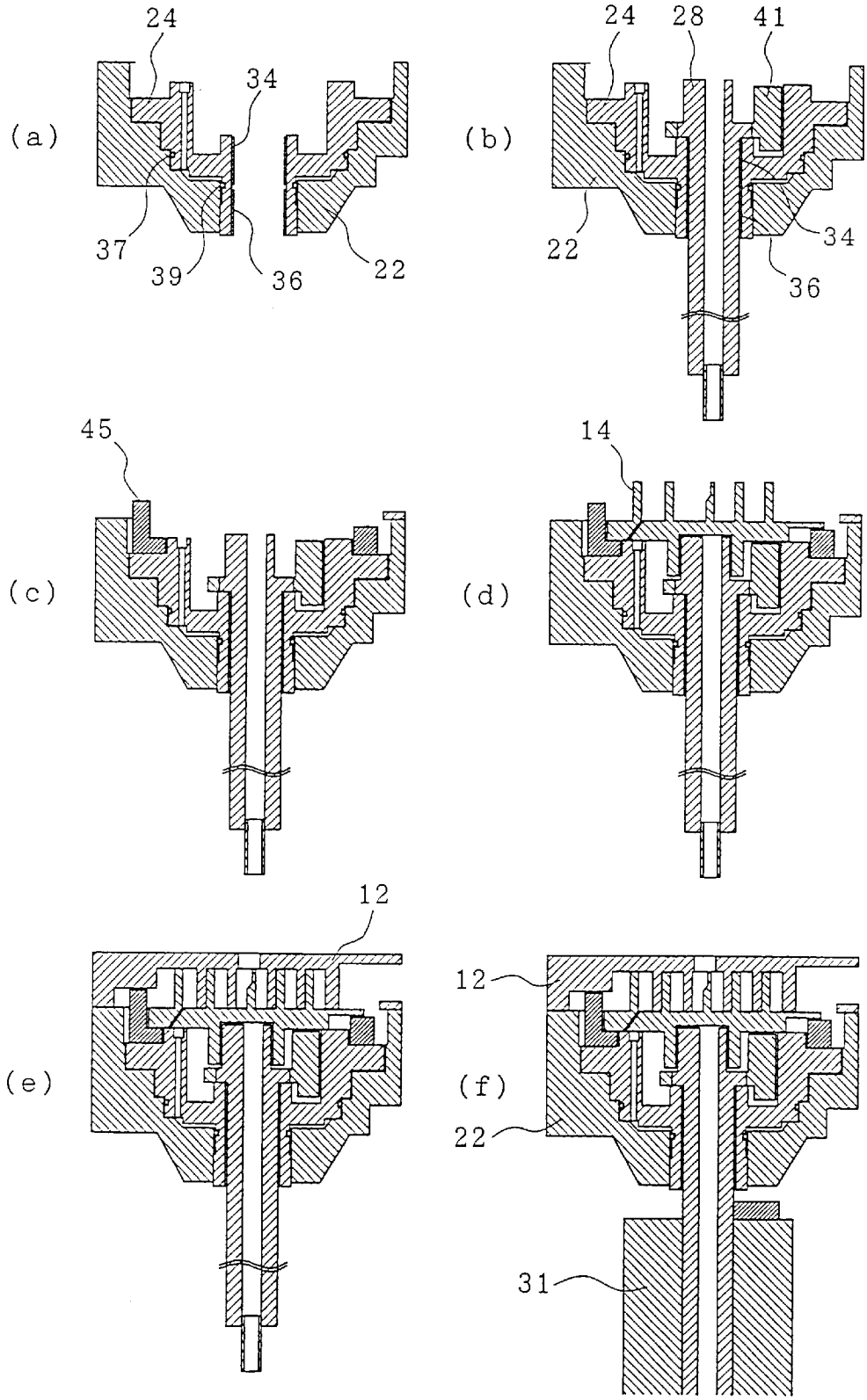
FIGS. 2(*a*)–2(*f*) are a series of sectional views showing various steps for assembling main parts of the scroll compressor of FIG. 1.

FIG. 2, shows the steps for assembling the principal parts of the scroll compressor according to the present invention.

Figure 3:
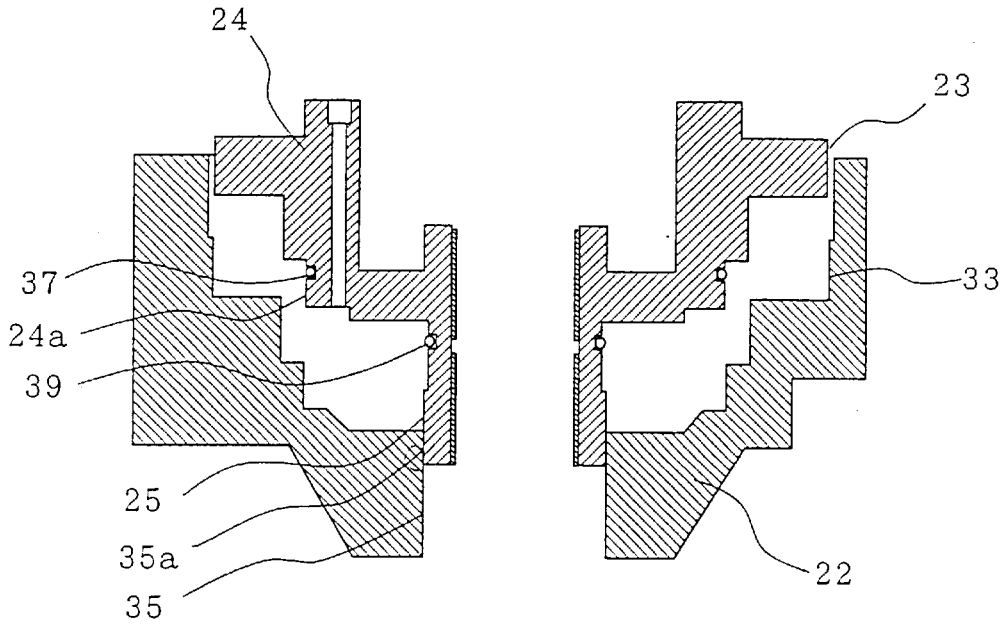
FIG. 3 is a sectional view showing the condition of the scroll compressor when the compliant frame is inserted into the guide frame.

First, as shown in (a) of FIG. 2, the sealing materials 37 and 39, a first bearing 34 and a second bearing 36 are attached to the compliant frame 24. The compliant frame 24 is then inserted into the guide frame 22. At this time, as shown in FIG. 3, the small-diameter lower cylindrical surface (first cylindrical surface) 25 of the compliant frame 24 is first engaged with an entrance surface 35*a* of the lower cylindrical surface 35 of the guide frame 22. Then, the lower cylindrical surface 25 of the compliant frame 24 is inserted into the lower cylindrical surface 35 of the guide frame 22 while being guided by the lower cylindrical surface 35 (this action is called a leading action of the lower cylindrical surface 25). After that, the large-diameter upper cylindrical surface (second cylindrical surface) 23 is engaged with an upper cylindrical surface 33 of the guide frame 22. Thus, the compliant frame 24 can be inserted into the guide frame 22 straightly and smoothly. In addition, even if the compliant frame 24 is inserted with a slight inclination, the inclination of the compliant frame 24 can be corrected easily because the upper cylindrical surfaces 23 and 33 have such a dimensional relationship that the upper cylindrical surface (second cylindrical surface) 23 is not yet engaged with the upper cylindrical surface 33 of the guide frame 22 in the initial stage of the insertion. Accordingly, it is easy to insert the compliant frame 24 and also it is difficult for the compliant frame 24 to incline. Thus, it is possible to insert the compliant frame 24 into the guide frame 22 smoothly without producing any jamming of the compliant frame 24.

Thereafter, as shown in (b) of FIG. 2, a main shaft 28 to which a main shaft balancer 41 has been shrink-fitted or press-fitted, is inserted into the first bearing portion 34 and the second bearing portion 36 of the compliant frame 24. Next, an Oldham's ring 45, an oscillating scroll member 14 and a fixed scroll member 12 are set in place sequentially on the compliant frame 24 (see (c)–(e) of FIG. 2). Then, the fixed scroll member 12 is fixed to the guide frame 22 by clamping with bolts (not shown). As regards the direction of clamping, the bolts may be fastened from either the fixed scroll member side or the guide frame side. After that, a rotor 31 is inserted from below the main shaft 28, and fixed to the main shaft 28 (see (e) of FIG. 2).

Embodiment 2

Figure 4:
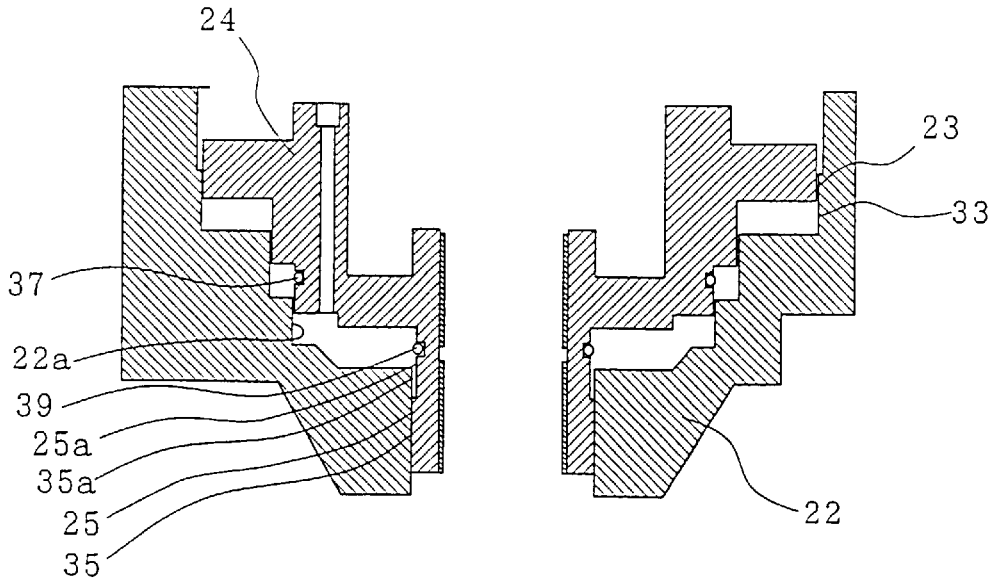
FIG. 4 is a sectional view showing the condition when a compliant frame is inserted into a guide frame according to Embodiment 2 of the present invention.

FIG. 4 shows another embodiment of the present invention. FIG. 4 is an explanatory view showing the manner in which a compliant frame 24 is inserted into a guide frame 22. Specifically, an upper cylindrical surface 23 and a lower cylindrical surface 25 of the compliant frame 24 are engaged with an upper cylindrical surface 33 and a lower cylindrical surface 35 of the guide frame 22 respectively. Then, upper and lower sealing materials 37 and 39 are engaged with an intermediate cylindrical surface 22*a* and the lower cylindrical surface 35 of the guide frame 22, respectively. It is a matter of course so that also in this embodiment, the lower cylindrical surface 25 of the compliant frame 24 is first engaged with the lower cylindrical surface 35 of the guide frame 22 in the same manner as in Embodiment 1. Thereafter, the upper cylindrical surface 23 of the compliant frame 24 is engaged with the upper cylindrical surface 33 of the guide frame 22.

In this embodiment, the clearances (guide portion clearances) between the upper and lower cylindrical surfaces 23 and 25 of the compliant frame 24 and the upper and lower cylindrical surfaces 33 and 35 of the guide frame 22 are preset to be smaller than the clearances (seal portion clearances) between the compliant frame 24 and the guide frame 22 in the portions where the sealing materials 37 and 39 are attached, respectively. Accordingly, the upper cylindrical surfaces 23 and 33, and the lower cylindrical surfaces 25 and 35 are first engaged with each other, respectively. Then, the sealing materials 37 and 39 are engaged with the intermediate cylindrical surface 22*a* and the lower cylindrical surface 35 of the guide frame 22, respectively. Thus, the sealing materials 37 and 39 can be engaged with the guide frame 22 while the posture of the compliant frame 24 is kept straight with respect to the guide frame 22. It is therefore possible to prevent the sealing materials from being damaged or so. In addition, the lower one of the above-mentioned seal portion clearances is a clearance between the lower cylindrical surface 35 of the guide frame 22 and a lower seal portion cylindrical surface 25*a* of the compliant frame 24. The lower seal portion cylindrical surface 25*a* is a portion to which the lower sealing material 39 is attached. The lower seal portion cylindrical surface 25*a* is also formed to have an outer diameter slightly smaller than that of the lower cylindrical surface 25. Of course, the lower cylindrical surface 35 side of the guide frame 22 may be slightly increased in diameter while causing the lower cylindrical surface 25 of the compliant frame 24 to have the uniform diameter over its whole length. However, the way described in this embodiment is preferable in view of making the compliant frame 24 difficult to be inclined when it is inserted into the guide frame 22.

Embodiment 3

Figure 5:
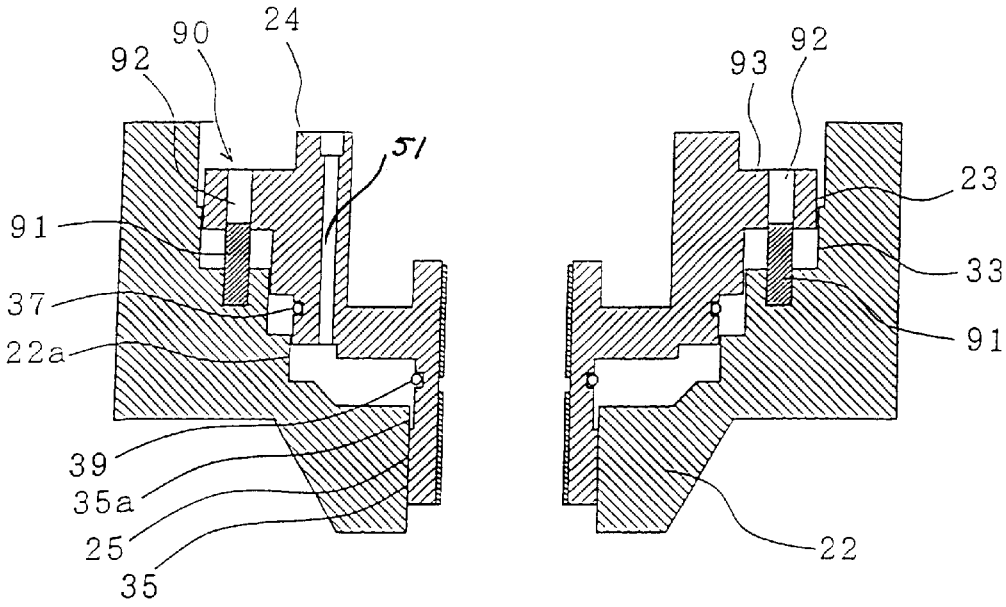
FIG. 5 is a sectional view showing the condition when a compliant frame is inserted into a guide frame according to Embodiment 3 of the present invention.

FIG. 5 shows still another embodiment of the present invention, and it is an explanatory view showing the manner in which a compliant frame 24 is inserted into a guide frame 22.

In this embodiment, phase setting means 90 is provided for the compliant frame 24. As for example, the phase setting means 90 is constituted by pins and holes. A plurality of pins 91 are erectly provided on the guide frame 22. Holes 92 through which the pins 91 are inserted are provided in a flange portion 93 which forms an upper cylindrical surface 23 of the compliant frame 24.

By this phase setting means 90, the phase of the compliant frame 24 can be determined with respect to the guide frame 22 as soon as the compliant frame 24 is inserted into the guide frame 24. In other words, by the provision of the phase setting means 90, a communication passageway 51 can be positioned. In addition, sealing materials 37 and 39 are engaged with the guide frame 22 after the phase of the compliant frame 24 has been thus locked with respect to the guide frame 22. Accordingly, after the sealing materials 37 and 39 have been engaged thus, the compliant frame 24 does not have to be rotated for phase adjustment as in the case of the prior art. It is therefore possible to prevent the sealing materials from being damaged or the like.

Incidentally, although the description was made of the case where the phase setting means 90 was constituted by the pins 91 and the holes 92, the phase setting means 90 may be constituted by any other means so long as the means prevents the compliant frame 24 from rotating while allowing the compliant frame 24 to move in the axial direction of the scroll compressor. For example, the phase setting means 90 may be constituted by keys and key grooves. Further, although the plurality of pins are shown in FIG. 5, the phase setting means 90 may have only one pin if the pin can fulfil the equivalent function.

What is claimed is:

1. A scroll compressor disposed in a closed vessel, comprising:

a guide frame attached to said closed vessel the guide frame having bottom and top ends in an axial direction and first and second guide frame cylindrical surfaces, the first guide frame cylindrical surface being provided near the bottom end, the second guide frame cylindrical surface being provided near the top end and having a larger diameter than that of the first guide frame cylindrical surface;

a compliant frame disposed in said guide frame having first and second compliant frame cylindrical surfaces fitted in the first and second guide frame cylindrical surfaces, respectively;

a fixed scroll member attached to the guide frame, the fixed scroll member having plate-like scroll teeth; and an oscillating scroll member having plate-like scroll teeth adapted to engage with the plate-like scroll teeth of said fixed scroll member to form a compression chamber therebetween;

wherein a distance between a bottom end of the first compliant frame cylindrical surface and a bottom end of the second compliant frame cylindrical surface in the axial direction is longer than a distance between a top end of the first guide frame cylindrical surface and a top end of the second guide frame cylindrical surface in the axial direction.

2. A scroll compressor according to claim 1, further comprising at least two sealing members each of which is placed in a gap between the guide frame and the compliant frame, wherein the sealing members are disposed in the compliant frame between the first and second compliant frame cylindrical surfaces, and a distance between the top end of the second guide frame cylindrical surface and a top end of each gap for each sealing member in the axial direction is longer than a distance between the bottom end of the second compliant frame cylindrical surface and the sealing member in the axial direction.

3. A scroll compressor according to claim 2, further comprising:

phase setting means for setting a phase of the compliant frame and preventing the compliant frame from rotating with respect to said guide frame, the phase setting means comprising a hole provided in the compliant frame in the axial direction and a pin fixed to the guide frame and fitted into the hole, wherein a distance between a top end of the pin and the top end of each gap for each sealing member in the axial direction is longer than a distance between a bottom end of the hole and the sealing member disposed in the compliant frame.

* * * * *